US005481776A

United States Patent [19]

Briscoe

[11] Patent Number: 5,481,776

[45] Date of Patent: Jan. 9, 1996

[54] BRUSH PRESSURE SYSTEM

[76] Inventor: William A. Briscoe, Wades House, Barton Stacey, Winchester, Hampshire, United Kingdom

[21] Appl. No.: 203,557

[22] Filed: Mar. 1, 1994

[51] Int. Cl.[6] ..... A47L 11/16; A47L 11/24

[52] U.S. Cl. ..... 15/49.1; 15/87; 451/353

[58] Field of Search ..... 15/49.1, 50.1, 15/50.2, 52.2, 87, 385; 51/177; 299/41; 451/353

[56] References Cited

U.S. PATENT DOCUMENTS

| | | | |
|---|---|---|---|
| 1,000,696 | 8/1911 | Schlueter | 15/49.1 |
| 1,139,407 | 5/1915 | Finnell | 15/49.1 |
| 1,581,687 | 4/1926 | Pape | 15/49.1 |
| 1,773,993 | 8/1930 | Gillis | 15/50.1 |
| 2,300,280 | 10/1942 | Teager | 15/87 |
| 3,496,681 | 2/1970 | Oswald | 15/49.1 |
| 4,041,567 | 8/1977 | Burgoon | 15/50.1 |

*Primary Examiner*—Edward L. Roberts, Jr.
*Attorney, Agent, or Firm*—Young & Thompson

[57] ABSTRACT

A brush pressure system for a cleaning or sweeping machine, particularly of the pedestrian type, has elements for biasing the brush or brushes against the surface to be cleaned or swept, at a desired value and preferably at a controllably variable value. Long springs mounted in spring tubes which are compressed by an electrical actuator are the preferred option. With a controllable brush pressure the cleaning or sweeping machine is more adaptable, can be used for both heavy duty cleaning or scrubbing tasks and light sweeping tasks without the need to for resetting the machine in the factory and without wearing out the expensive brushes or damaging the floor surface.

11 Claims, 1 Drawing Sheet

BRUSH PRESSURE SYSTEM

DESCRIPTION

FIELD OF THE INVENTION

The present invention relates to a brush pressure system and is particularly applicable to floor cleaning machines using rotating brushes for example to scrubbing and/or sweeping machines.

BACKGROUND TO THE INVENTION

Known floor cleaning machines use rotating brushes to scrub or polish a floor, mounted on a wheeled frame which is pedestrian controlled or in larger models is ridden on by the operator. Sufficient pressure is usually put on the brushes by the weight of the brush heads and motor assemblies in combination with the weight of the water tanks, though in larger models, hydraulic actuators are used, particularly on the ride-on machines. However, as brushes wear down the cleaning pressure decreases and hence the cleaning power is less satisfactory.

More recent pedestrian machines have tried to compensate for this by incorporating small springs into the brush heads so as to take up the wear in the brushes. These however have been found to be unacceptably unreliable in many circumstances because these springs have a tendency to lock and cause the driving motors to cut-out. In any case, in known machines, the maximum pressure is limited and there is no way of adjusting the pressure to be applied by the brushes. Pressures of up to 200 lbs. pressure can be achieved with the pedestrian machines but this is not adequate for heavy duty cleaning on very contaminated floors and is too high a pressure for normal maintenance cleaning. If the brush pressure is high then the brushes wear down very quickly. The sort of brushes used in this equipment are very expensive and excessive wear is unacceptable. In any case, excessive prolonged brush pressure may damage certain floor surfaces. On the other hand, if the brush pressure is too light then the cleaning machine will not be effective on heavily soiled floors.

Known machines make no allowance for uneven ground and tend to malfunction unless the floor is flat. Also, known machines are difficult and heavy to operate and manoeuvre and this makes them difficult, for example, for women to use.

It is an object of the present invention to provide a brush pressure system which does not have these disadvantages.

SUMMARY OF THE INVENTION

According to the present invention there is provided apparatus for providing pressure on a brush in a cleaning or sweeping machine, the apparatus comprising spring means for biasing the brush against a surface to be cleaned or swept and means for tensioning the spring means so as to set the brush pressure at a desired value.

The cleaning or sweeping machine may be used to clean or sweep any surface for example floors, pavements, roads and even non-horizontal surfaces such as walls.

The brush pressure can be varied by controlling the tension in the spring means. An actuator can be used to control this tension, for example by compressing the spring means; the greater the compression the greater the brush pressure on the floor and the more effective the cleaning power of the machine. The actuator is preferably electrically driven though it could be hydraulically or even manually driven.

The spring tension and thus the pressure may be set in the factory when the cleaning or sweeping machine is manufactured or by a service engineer when the cleaning or sweeping machine is serviced to suit a particular cleaning task. Alternatively, the pressure may be adjustable by the operator to suit the task being performed. For light cleaning or polishing, a light pressure is preferable and minimises brush wear, whereas for heavy cleaning on highly contaminated floors, more pressure is needed.

According to a preferred embodiment of the present invention at least one spring is mounted in a spring tube which is driven by an actuator controlled by a two-position rocker switch on the machine's control panel. The rocker switch is biased to the off-position and is rocked one way to increase pressure and the other way to decrease pressure. Releasing the switch returns it to the neutral or "off" position stopping movement.

Preferably a pair of springs is used, each spring being mounted in a spring tube, and both driven by a single actuator controlled by such a rocker switch.

The brush pressure can be measured either by sensing the current drawn by the brush motors or by mechanically measuring the compression of the springs and can be displayed on the control panel alongside the switch. Feedback could be used to control the spring compression as a function of the pressure measured.

The apparatus can be used to control a single brush head or more usually a dual head but also multiple heads either together or individually.

The most effective cleaning and sweeping machines generally use round or elliptical shaped brushes mounted to rotate in a plane generally parallel with the floor. The bristles of the brushes are all set generally perpendicular to the surface to be cleaned or swept. However, it is envisaged that the brush pressure system of the present invention would be equally applicable to a cleaning or sweeping machine with a cylindrical brush head with bristles radially mounted and which rotates about an axis parallel to the surface to be cleaned or swept. In this case it would be preferable to mount an apparatus according to the invention at each end the cylinder shaft.

In one preferred embodiment which is particularly applicable to a pedestrian machine, the springs are heavy duty springs at least 6 inches (14.4 cm) long and advantageously 12 to 15 inches (28.8 to 36 cm) long, though they may be longer. The required length of the spring will of course depend on many factors, including for example the type of machine (longer springs will be needed in a ride-on machine), the gauge of the spring (heavy duty springs need to be longer than light duty springs to provide the required suspension characteristics to compensate for uneven ground), the cleaning or sweeping power required and the relative positions of the actuator and the spring tubes. A single spring could be used or alternatively two or three springs totalling the required length could be mounted in the spring tube.

Brush pressure can also be altered by changing the springs though obviously this is not something that can be done easily by the operator and would instead usually by done by a service engineer or similar person.

A brush pressure system according to the present invention has considerable advantages over any known system. It provides a high, yet easily controllable brush pressure allowing for heavy cleaning of contaminated floors yet allowing light cleaning with the same machine if and when desired thus minimising unnecessary brush wear and avoiding damage to floors or surfaces to be cleaned. This system provides good suspension allowing for a floating cleaning or sweeping head enabling a machine to go over rough or uneven surfaces without malfunctioning.

A cleaning or sweeping machine incorporating a system according to the invention aims to be easily controllable even by a relatively physically weak operator, and aims to provide more cleaning or sweeping power than was hitherto possible in pedestrian machines.

DETAILED DESCRIPTION

Figure 1:
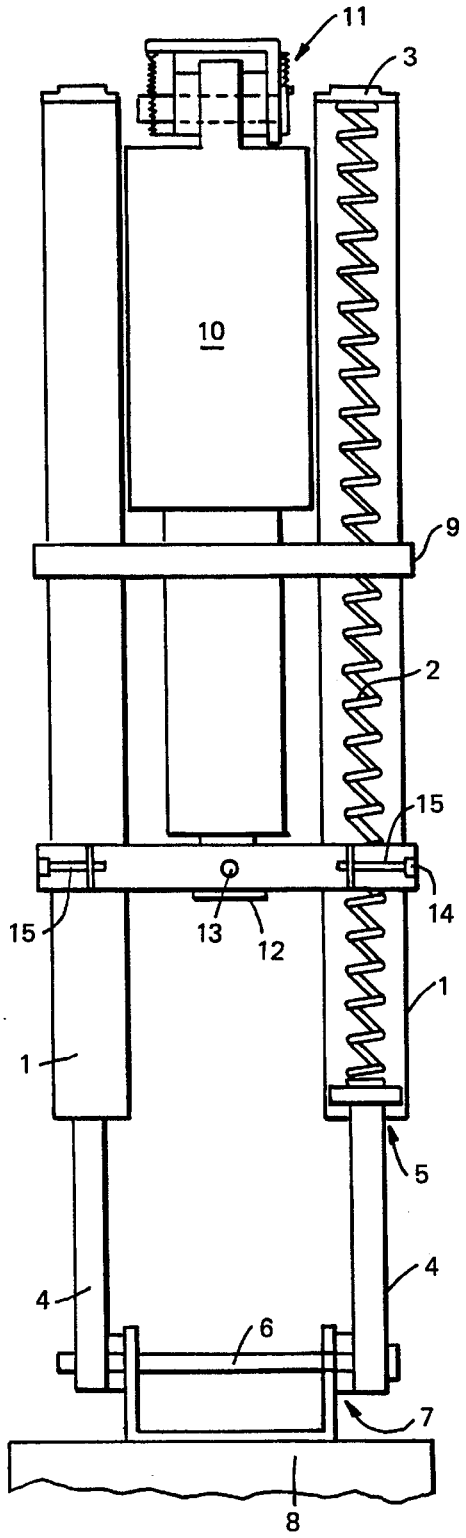
FIG. 1 shows a cross-section elevational view of the apparatus of the invention.

In FIG. 1, the apparatus comprises two spring tubes 1, containing springs 2. The right hand tube 1 in the figure is shown in cut-away to illustrate spring 2. Each spring is fixed at one end to the upper end of the tubes at 3 and at the other end to a spring rod 4 which slides through an aperture 5 into the respective spring tube 1. The spring rode 4 are connected together by rod 6 and are fixed via assembly 7 to the brush head assembly 8.

The tubes 1 are prevented from rotating by a steadying plate 9 An actuator 10 is secured to a bulkhead 11 of a cleaning machine. Actuator 10 drives actuator rod 12 which is shown in closed up position in the figure. The actuator rod 12 is fixed by a pin 13 to actuator plate 14 which is clamped to both spring tubes 1 by clamping bolts 15. Thus when the actuator is activated to drive the actuator rod 12 downwards, the spring tubes 1 move downwards and the springs 2 are compressed causing a higher pressure to be exerted on the brush head assembly whilst stall providing suspension to accommodate uneven floors and brush wear. Typically, the effective spring lengths, in an uncompressed state, are around 15 inches and this is particularly suitable for a 26/32 inch brush pressure system. This can provide a range of 0 to 450 lb pressure in a loaded pedestrian cleaning machine fitted with apparatus according to the invention, compared to the maximum 200 lb pressure available using known apparatus.

The pressure can be further adjusted by changing the springs or the clamping position of the spring tubes.

This system is particularly adjustable as the actuator can be stopped anywhere in its stroke.

Usually brush head assembly 8 will comprise a pair of circular or elliptical Brushes rotating in a plane generally parallel to the floor (or surface to be cleaned or swept). However, up to four brushes are in use in some cleaning machines and the apparatus of the invention could be used to control all such four brushes together or individually—separate actuators could be used. Of course a cylindrical brush head could be equally easily controlled mounted on the brush head assembly 8 or alternatively controlled at each end of its shaft by respective separate apparatus of FIG. 1

Figure 2:
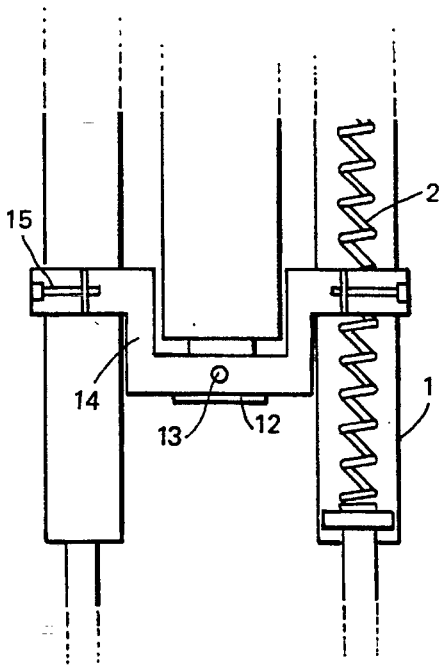
FIG. 2 shows an alternative arrangement of part of the apparatus of FIG. 1

FIG. 2 illustrates an alternative arrangement of the actuator plate 14 wherein the plate has a U-shaped cross section as shown so that it is clamped to the spring tubes 1 in a plane spaced from that in which it is clamped to the actuator rod 12. This arrangement enables low brush pressures to be achieved with heavy duty springs.

What I claim is:

1. A sweeping apparatus comprising:

a sweeping brush head assembly for contacting a floor to effect sweeping a surface to be swept;

spring means mounted to act as suspension means including means for biasing the brush head assembly towards the surface;

tensioning means for tensioning the spring means so as to set the pressure the brush head assembly for movement towards and away from the surface; and said spring means being selectively adjustable said tensioning means over a continuous range to provide any one of a plurality of bias towards the surface.

2. Apparatus according to claim 1, wherein said tensioning means include means for controlling the tension in said spring means so as to vary the bias of said brush head assembly.

3. Apparatus according to claim 2, wherein said means for controlling the tension comprise an actuator arranged to compress said spring means.

4. Apparatus according to claim 3, wherein said actuator is hydraulically drivable.

5. Apparatus according to claim 3, wherein the spring means include two spring tubes and two springs, each spring being mounted in a respective spring tube, and wherein said actuator is arranged for compressing said two springs simultaneously.

6. Apparatus according to claim 1, wherein the spring means include at least one spring tube and at least one spring mounted in said at least one spring tube.

7. Apparatus according to claim 6, wherein said at least one spring is at least 6 inches long.

8. Apparatus according to claim 1, wherein the brush head assembly includes a dual brush head.

9. Apparatus according to claim 1, wherein said spring means comprise a plurality of springs.

10. A sweeping machine comprising:

a sweeping brush head assembly for contacting a floor to effect a sweeping action of a surface to be swept;

means for biasing the brush head assembly against the surface, said biasing means including at least one spring tube and at least one spring mounted in said at least one spring tube, and said biasing means having means compressing said at least one spring within said at least one spring tube; and means for setting the biasing means so as to set a pressure exerted by said brush head assembly, at a desired value.

11. Apparatus according to claim 10, wherein the setting means include controlling means constructed and arranged for varying the pressure of said brush head assembly.

* * * * *

UNITED STATES PATENT AND TRADEMARK OFFICE

CERTIFICATE OF CORRECTION

PATENT NO. : 5,481,776

DATED : January 9, 1996

INVENTOR(S) : William Anthony BRISCOE

It is certified that error appears in the above—identified patent and that said Letters Patent is hereby corrected as shown below:

Title page, insert the following:

--[30] Foreign Application Priority Data

Nov. 17, 1993 [UK] United Kingdom ..... 93 23718.8--

Signed and Sealed this

Twentieth Day of August, 1996

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,481,776

DATED : January 9, 1996

INVENTOR(S) : William Anthony BRISCOE

It is certified that error appears in the above-indentified patent and that said Letters Patent is hereby corrected as shown below:

Column 4, line 17, change "said spring means being selectively adjustable said tensioning means" to --said spring means being selectively adjustable by said tensioning means--.

Signed and Sealed this

First Day of October, 1996

*Attest:*

*Attesting Officer*

BRUCE LEHMAN

*Commissioner of Patents and Trademarks*